US007131368B2

(12) United States Patent
Jeon

(10) Patent No.: US 7,131,368 B2
(45) Date of Patent: Nov. 7, 2006

(54) VARIABLE REGENERATION VALVE OF HEAVY EQUIPMENT

(75) Inventor: Man Suk Jeon, Kyungsangnam-do (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 0 days.

(21) Appl. No.: 11/140,138

(22) Filed: May 27, 2005

(65) Prior Publication Data

US 2006/0016327 A1 Jan. 26, 2006

(30) Foreign Application Priority Data

Jul. 23, 2004 (KR) ..... 10-2004-0057709

(51) Int. Cl.
*F15B 13/04* (2006.01)

(52) U.S. Cl. ..... 91/436; 137/596.2

(58) Field of Classification Search ..... 60/413; 91/420, 436; 137/596.2
See application file for complete search history.

(56) References Cited

U.S. PATENT DOCUMENTS 3,771,558 A * 11/1973 Ailshie ..... 91/436
4,642,019 A * 2/1987 Sutton ..... 91/516
4,723,476 A * 2/1988 Stucky ..... 91/436
5,862,831 A * 1/1999 Chung et al. ..... 91/436

* cited by examiner

*Primary Examiner*—Thomas E. Lazo
(74) *Attorney, Agent, or Firm*—Ladas and Parry LLP

(57) ABSTRACT

Disclosed is a variable regeneration valve of a heavy equipment in which hunting due to repeated motion of a spool does not occur in a regeneration valve that supplies a return flow of an actuator to a supply port during single operation of the actuator or its composite operation such as composite driving of arm in and swing, and a structure of the variable regeneration valve is simplified to improve process characteristics. The variable regeneration valve includes a hydraulic pump, an actuator connected with the hydraulic pump, a control valve controlling operation, stop, and direction of the actuator, a regeneration switching valve having a first piston, a switching spool, a first elastic member, and a second piston, a first damping orifice, and a second damping orifice.

5 Claims, 3 Drawing Sheets

VARIABLE REGENERATION VALVE OF HEAVY EQUIPMENT

CROSS-REFERENCE TO RELATED APPLICATIONS

This application claims benefit under 35 U.S.C. § 119 from Korean Patent Application No. 2004-57709, filed on Jul. 23, 2004, the entire content of which is incorporated herein by reference.

BACKGROUND OF THE INVENTION

1. Field of the Invention

The present invention relates to a variable regeneration valve of a heavy equipment, and more particularly to, a variable regeneration valve of a heavy equipment in which hunting due to repeated motion of a spool does not occur in a regeneration valve that supplies a return flow of an actuator to a supply port during single operation of the actuator or its composite operation such as composite driving of arm in and swing, and a structure of the variable regeneration valve is simplified to improve process characteristics.

2. Description of the Related Art

Generally, regeneration means that a desirable operational speed of an actuator is ensured and cavitation due to shortage of flow is prevented from occurring in a supply side of the actuator by supplying the flow generated in a return side of the actuator to the supply side.

Such regeneration is based on an actuator that can be operated by its load not flow. For example, in case of an excavator, a return flow of high pressure obtained by load of a boom when the boom descends is used when the boom ascends.

FIG. 1 illustrates the state that a spool of an arm control valve is switched to drive an arm cylinder in an "arm in" mode, and FIG. 2 is an enlarged sectional view illustrating a main part of a regeneration valve shown in FIG. 1.

As shown in FIG. 1 and FIG. 2, a control valve provided with a regeneration valve for a heavy equipment according to the related art includes a hydraulic cylinder C (arm cylinder) connected with a hydraulic pump (not shown), an arm control valve AV provided in a path between the hydraulic pump and the hydraulic cylinder, controlling operation, stop, and direction of the hydraulic cylinder by switching a spool S when an external pilot signal pressure is applied thereto, and a regeneration valve RV having a regeneration switching spool 6, switched by discharge pressure of the hydraulic pump to control hydraulic oil returning from the hydraulic cylinder to the hydraulic tank.

As shown in FIG. 2, the regeneration valve RV includes a piston 8 moving depending on the discharge pressure of the hydraulic pump, a sleeve 7 having orifices 10 and 11 that respectively communicate with a return port A and a tank port T, the regeneration switching spool 6 elastically provided in the sleeve 7 by a valve spring 5 and switched during motion of the piston 8 to control regeneration oil moving from the return port A to the tank port T, and a piston 3 provided at the end of the valve spring 5, increasing or reducing elasticity of the valve spring 5 while moving depending on an external signal.

The single operation of the actuator will now be described.

If the spool S is switched to a right side when viewed from the drawing as an external pilot signal pressure is applied to a pilot port PP of the arm control valve AV, the hydraulic oil discharged from the hydraulic pump pushes a check valve 4 in an upward direction when viewed from the drawing after passing through the pump port and is supplied to a large chamber C1 of the hydraulic cylinder C.

The hydraulic oil discharged from a small chamber C2 of the hydraulic cylinder C pushes a holding poppet in an upward direction when viewed from the drawing and passes through the spool S. The hydraulic oil is then moved to the tank port T through the orifices 10 and 11.

At the same time, the hydraulic oil of the pump port 2 moves the piston 8 and the regeneration switching spool 6 to a right side of FIG. 2 to reduce the diameter of the orifice 10. This reduces pressure loss of the hydraulic oil moving from the return port A to the tank port T.

At this time, leakage oil occurs due to a clearance generated by difference between the inner diameter of the sleeve 7 and the outer diameter of the switching spool 6. The leakage oil is moved to a piston chamber 1 and to the tank port T through a drain hole 12 of the sleeve 7. In this case, rear pressure occurs in the piston chamber 1 due to a small diameter of the drain hole 12. The rear pressure increases with the lapse of time so that the switching spool 6 may be switched to a left side when viewed from the drawing, thereby moving the piston 8 to the left side.

In other words, the condition, [(pressure of the pump port 2) (water pressure area of the piston 8)]<[(rear pressure of the piston chamber 1) (water pressure area of the switching spool 6)] is fulfilled.

Meanwhile, since the sectional area of the orifice 11 is reduced if the switching spool 6 is switched to the left side, the pressure at the return port A increases rapidly. The increasing pressure is combined with the hydraulic oil of a rear pressure chamber 15 through the regeneration check valve CV and then moves the piston 8 to the right side in the drawing.

In other words, the condition, [(pressure of the pump port 2) (water pressure area of the piston 8)]>[(rear pressure of the piston chamber 1) (water pressure area of the switching spool 6)] is fulfilled.

Repetition of the above operation causes hunting of the equipment.

The composite operation of the actuator, for example, composite driving of arm in and swing, will be described.

In a state that the switching spool 6 and the piston 8 are moved to the right side, if a pilot signal pressure of 40K is applied to the pilot port PP of the regeneration valve RV to pivot the equipment, the piston 3 is moved to the right side so that the switching spool 6 and the piston pushed to the right side may be switched to the left side.

In other words, the condition, [(pressure of the pump port 2) (water pressure area of the piston 8)]<[(40K) (water pressure area of the piston 3)] is fulfilled.

The orifices 10 and 11 are fixed without motion until a certain pressure increases. Pressure loss at the return port A increases as the sectional area of the orifice 11 is reduced by switching of the switching spool 6. For this reason, the swing operation of the hydraulic cylinder C is first performed.

If the pressure loss value increases as the flow increases, the condition, [(pressure of the pump port 2) (water pressure area of the piston 8)]>[(water pressure area of the piston 3) (40K)] is fulfilled.

At this time, the piston 3, the switching spool 6 and the piston 8 are instantaneously moved to rapidly increase the sectional area of the orifice 11, thereby reducing the pressure loss value $\Delta P$.

If the pressure loss value is reduced, the condition, [(pressure of the pump port 2) (water pressure area of the piston 8)]<[(water pressure area of the piston 3) (40K)] is fulfilled.

Repetition of the above operation causes hunting of the equipment.

The hydraulic oil from the pump port 2 is leaked through the clearance generated between the piston 8 and the sleeve 7 and the clearance generated by difference between the inner diameter of the sleeve 7 and the outer diameter of the switching spool 6. The leakage oil is moved from a recess groove at a left side of the switching spool 6 to the piston chamber 1 through an orifice 13 of the switching spool 6.

At this time, the orifice 13 has a small diameter that fails to desirably discharge the hydraulic oil, thereby pressurizing the left side of the switching spool 6. Therefore, the hydraulic oil is moved by force of the switching spool 6 not external force caused by motion of the piston 8.

For this reason, the hydraulic pressure is relatively reduced against specifications of a hydraulic circuit, thereby deteriorating reliability.

SUMMARY OF THE INVENTION

Accordingly, the present invention is directed to a variable regeneration valve of a heavy equipment that substantially obviates one or more problems due to limitations and disadvantages of the related art.

An object of the present invention is to provide a variable regeneration valve of a heavy equipment in which hunting is avoided by a damping orifice during single operation of an actuator such as an arm cylinder or composite operation such as composite driving of arm in and swing.

Another object of the present invention is to provide a variable regeneration valve of a heavy equipment in which a structure of the variable regeneration valve is simplified to improve process characteristics.

To achieve these objects and other advantages and in accordance with the purpose of the invention, as embodied and broadly described herein, a variable regeneration valve for a heavy equipment includes a hydraulic pump, an actuator connected with the hydraulic pump, a control valve provided in a port between the hydraulic pump and the actuator, switched when an external pilot signal pressure is applied thereto, to control operation, stop, and direction of the actuator, a regeneration switching valve including a first piston provided between a return port of the actuator and a tank port to control hydraulic oil moving from the return port to the tank port and moved by the hydraulic oil discharged from the hydraulic pump, a switching spool switched by motion of the first piston to variably control an orifice rate of the return port and the tank port, a first elastic member elastically biasing the state of the tank port closed by pressurizing the switching spool against the first piston to its initial state, and a second piston elastically provided to oppose the switching spool by a second elastic member, a first damping orifice provided in a port that connects the hydraulic pump with the first piston, and a second damping orifice discharging the hydraulic oil leaked from the hydraulic pump to a piston chamber through the first piston and the switching spool.

Preferably, the variable regeneration valve further includes a third damping orifice formed in the switching spool to oppose the first piston, a fourth damping orifice provided in a signal pressure line that supplies a signal pressure to move the second piston, and holes formed to communicate with each other in a length direction and a radial direction of the switching spool to remove a rear pressure generated in a rear pressure chamber between the first piston and the switching spool.

Preferably, the variable regeneration valve further includes a sleeve screwed onto a guide in a single body, the first piston being slidably received in the guide and the switching spool being slidably received in the sleeve.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 3:
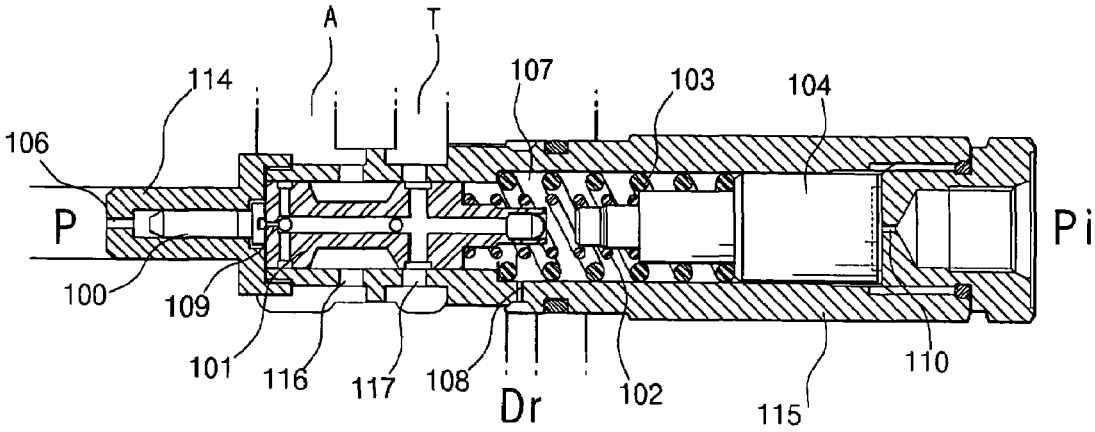
FIG. 3 is a sectional view illustrating a main part of a variable regeneration valve for a heavy equipment according to the present invention.
Figure 4:
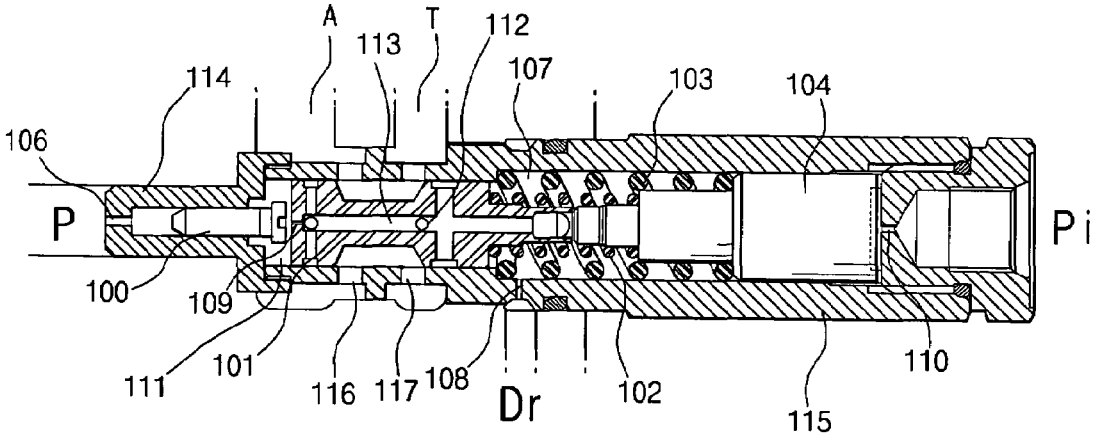
FIG. 4 is a state view illustrating use of the regeneration valve shown in FIG. 3.
Figure 5:
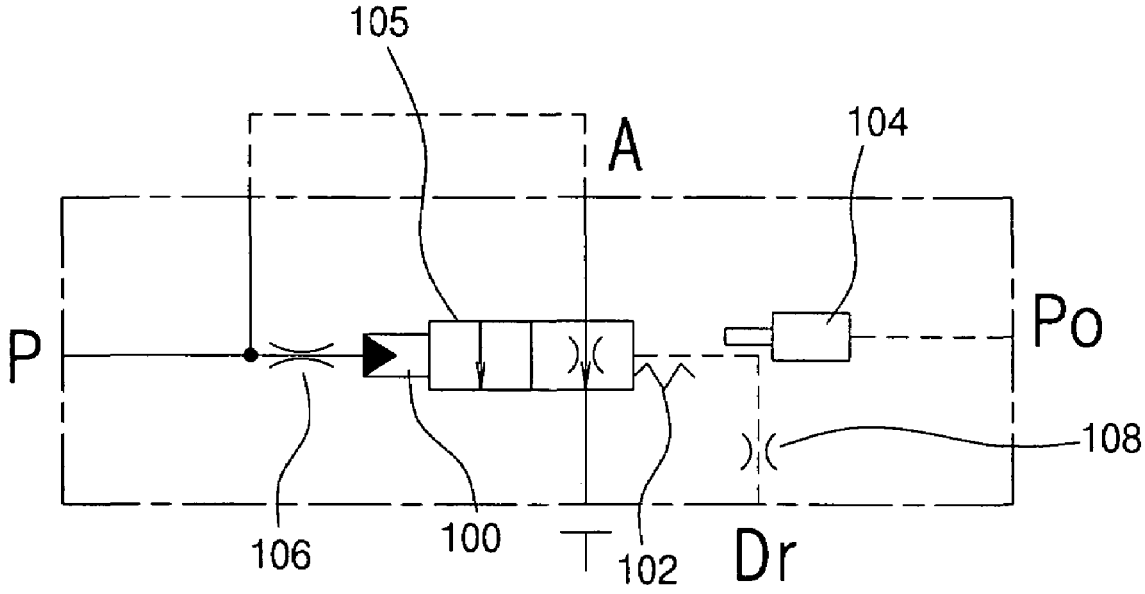
FIG. 5 is a hydraulic circuit diagram of a variable regeneration valve for a heavy equipment according to the present invention.

FIG. 3 illustrates the initial state of a regeneration switching valve according to the present invention, FIG. 4 illustrates the state that a spool is switched by hydraulic oil discharged from a hydraulic pump so that the hydraulic oil discharged from an actuator returns to a hydraulic tank, and FIG. 5 is a hydraulic circuit diagram of a variable regeneration valve shown in FIG. 3 and FIG. 4.

A variable regeneration valve for a heavy equipment according to the present invention includes a hydraulic pump P connected with an engine (not shown), an actuator such as an arm cylinder (not shown) connected with the hydraulic pump P, and a control valve CV provided in a port between the hydraulic pump P and the actuator, switched when an external pilot signal pressure is applied thereto to control operation, stop, and direction of the actuator.

As shown in FIG. 3 and FIG. 4, the variable regeneration valve for a heavy equipment according to the present invention further includes a regeneration switching valve 105. The regeneration switching valve 105 includes a first piston 100 provided between a return port A of the actuator and a tank port T to control the hydraulic oil moving from the return port A to the tank port T and moved by the hydraulic oil discharged from the hydraulic pump P, a switching spool 101 switched by motion of the first piston 100 to variably control an orifice rate of return port A and the tank port T, a first elastic member 102 elastically biasing the state of the tank port T closed by pressurizing the switching spool 101 against the first piston 100 to the initial state, and a second piston 104 elastically provided to oppose the switching spool 101 by a second elastic member 103.

The variable regeneration valve for a heavy equipment according to the present invention further includes a first damping orifice 106 provided in a port that connects the hydraulic pump P with the first piston 100, a second damping orifice 108 discharging the hydraulic oil leaked from the hydraulic pump P to a piston chamber 107 through the first piston 100 and the switching spool 101, a third damping orifice 109 formed in the switching spool 101 to oppose the first piston 100, and a fourth damping orifice 110 provided in a signal pressure line that supplies a pilot signal pressure to move the second piston 104.

Further, holes 112 and 113 are formed to communicate with each other in a length direction and a radial direction of the switching spool 101 to remove a rear pressure generated in a rear pressure chamber 111 between the first piston 100 and the switching spool 101.

Moreover, a sleeve 115 is screwed onto a guide 114 in a single body. The first piston 100 is slidably received in the guide 114 while the switching spool 101 is slidably received in the sleeve 115.

Hereinafter, the operation of the variable regeneration valve for a heavy equipment according to the present invention will be described with the accompanying drawings.

As shown in FIG. 4 and FIG. 5, the hydraulic oil discharged from the hydraulic pump P is supplied to the actuator by switching the spool of the control valve CV so that attachments such as arm may be driven.

At this time, as shown in FIG. 4, the first piston 100 is moved to the right side in the drawing by the hydraulic oil discharged from the hydraulic pump P, and the switching spool 101 tightly fixed to the first piston 100 is moved to the right side accordingly. The hydraulic oil discharged from the actuator is moved to the tank port T through the return port A and orifices 116 and 117.

Since the diameter of the orifice 117 is enlarged to reduce pressure, the switching spool 101 and the first piston 100 are pressurized by elastic force of the first elastic member 102 to move to a left side in the drawing.

As described above, when the switching spool 101 and the first piston 100 are moved to the left side by the elastic force of the first elastic member 102, the first damping orifice 106 formed in the guide 114 prevents the first piston 100 from being rapidly moved to the left side and the third damping orifice 109 formed in the switching spool 101 prevents the switching spool 101 from being rapidly moved to the left side. As a result, hunting can be avoided.

Furthermore, the third damping orifice 109 can prevent hunting due to collision of the first piston 100 against the switching spool 101.

Moreover, when the pilot signal pressure is applied to swing the equipment, the fourth damping orifice 110 formed in the signal pressure port prevents the second piston 104 from being rapidly moved against the switching spool 101, thereby avoiding hunting.

Meanwhile, since the rear pressure generated in the rear pressure chamber 111 between the first piston 100 and the switching spool 101 is discharged to the tank port through the holes 112 and 113, it is possible to prevent performance of the equipment from being deteriorated in comparison with its specifications.

Since the guide 114 is screwed onto the sleeve 115 in a single body, the regeneration switching valve 105 can be assembled or disassembled in an assembly state. This reduces working processes, thereby improving working conditions.

The inner diameter of the sleeve 115 corresponding to the outer diameter of the switching spool 101 can mechanically be processed with precision and process characteristics more excellent than that of the existing sleeve can be obtained, thereby improving productivity.

Figure 1:
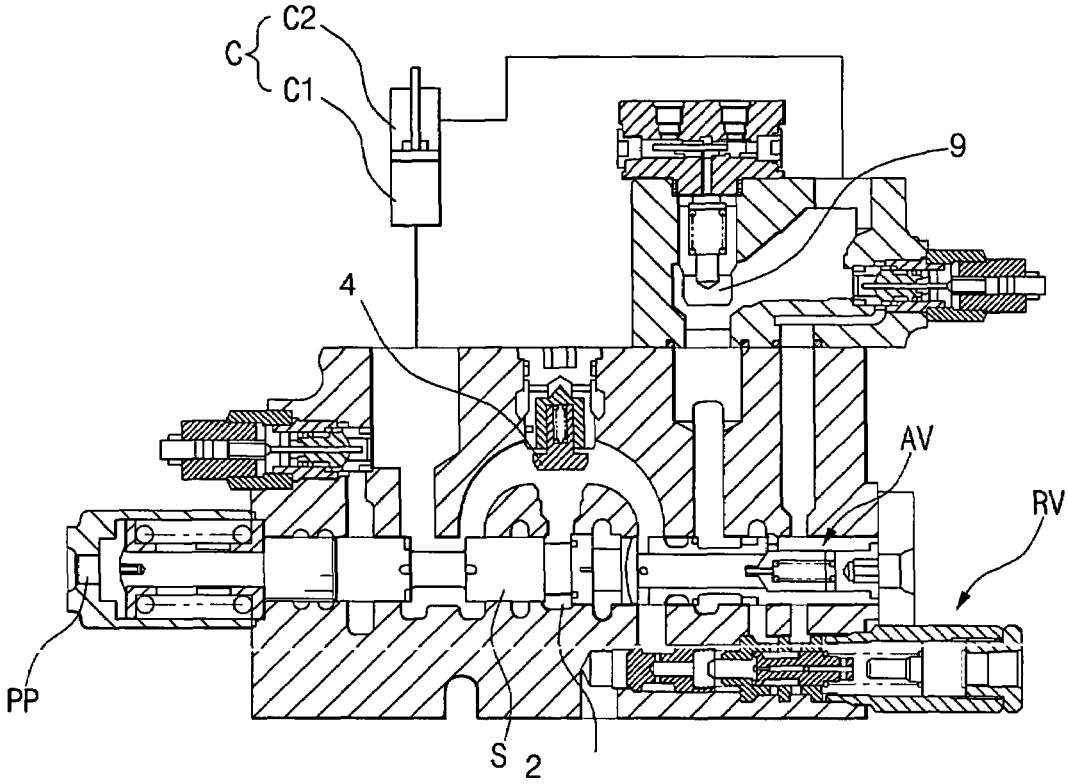
Fig.1 Prior Art
FIG. 1 is a state view illustrating use of a regeneration valve for a heavy equipment according to the related art.
Figure 2:
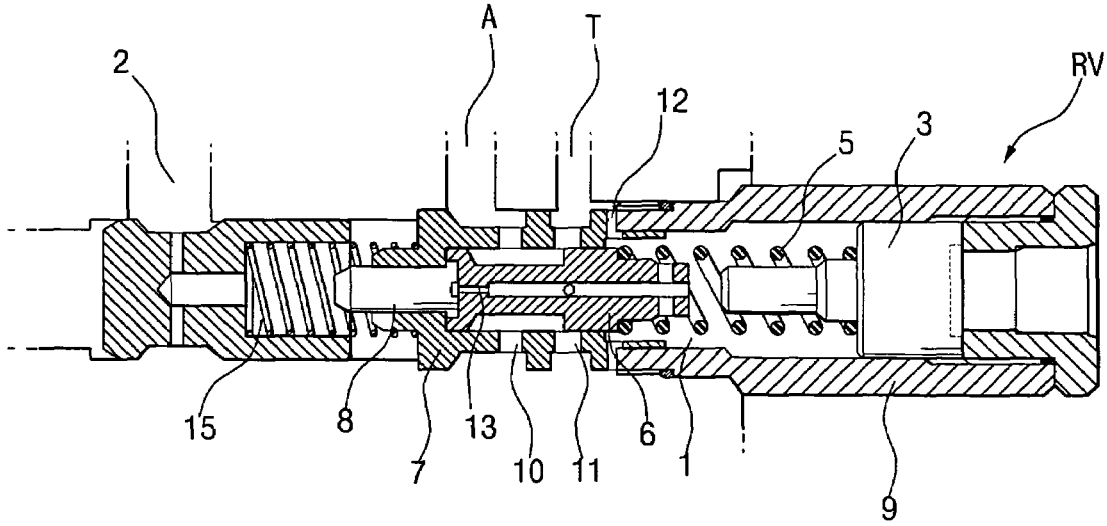
Fig.2 Prior Art
FIG. 2 is a sectional view illustrating a main part of a regeneration valve shown in FIG. 1.

Further, in the related art, two sleeves 7 and 9 are provided as shown in FIG. 2 to respectively receive the switching spool 6 and the piston 3. By contrast, in the present invention, only one sleeve 115 is provided as shown in FIG. 3 and FIG. 4 to receive the switching spool 101 and the second piston 104, so that corresponding attachments may be reduced, thereby reducing the cost.

As described above, the variable regeneration valve for a heavy equipment according to the present invention has the following advantages.

Hunting can be avoided by the damping orifices during single operation of the actuator such as an arm cylinder or composite operation such as composite driving of arm in and swing.

In addition, since corresponding attachments can be reduced by simplifying the structure of the variable regeneration valve, process characteristics can be improved, thereby reducing the cost.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A variable regeneration valve for a heavy equipment comprising:

a hydraulic pump;

an actuator connected with the hydraulic pump;

a control valve provided in a port between the hydraulic pump and the actuator, switched when an external pilot signal pressure is applied thereto, to control operation, stop, and direction of the actuator;

a regeneration switching valve including a first piston provided between a return port of the actuator and a tank port to control hydraulic oil moving from the return port to the tank port and moved by the hydraulic oil discharged from the hydraulic pump, a switching spool switched by motion of the first piston to variably control an orifice rate of the return port and the tank port, a first elastic member elastically biasing the state of the tank port closed by pressurizing the switching spool against the first piston to its initial state, and a second piston elastically provided to oppose the switching spool by a second elastic member;

a first damping orifice provided in a port that connects the hydraulic pump with the first piston; and a second damping orifice discharging the hydraulic oil leaked from the hydraulic pump to a piston chamber through the first piston and the switching spool.

2. The variable regeneration valve for a heavy equipment according to claim 1, further comprising a third damping orifice formed in the switching spool to oppose the first piston.

3. The variable regeneration valve for a heavy equipment according to claim 1, further comprising a fourth damping orifice provided in a signal pressure line that supplies a signal pressure to move the second piston.

4. The variable regeneration valve for a heavy equipment according to claim 1, further comprising holes formed to communicate with each other in a length direction and a radial direction of the switching spool to remove a rear pressure generated in a rear pressure chamber between the first piston and the switching spool.

5. The variable regeneration valve for a heavy equipment according to claim 1, further comprising a sleeve screwed onto a guide in a single body, the first piston being slidably received in the guide and the switching spool being slidably received in the sleeve.

* * * * *